US007107775B2

(12) United States Patent
Unger et al.

(10) Patent No.: US 7,107,775 B2
(45) Date of Patent: Sep. 19, 2006

(54) COLD CONTROL DAMPER ASSEMBLY

(75) Inventors: Larry Eugene Unger, Southside, AL (US); Mike Nick Glavaris, Jr., Grand Rapids, MI (US)

(73) Assignee: Mid-South Products Engineering, Inc., Gadsden, AL (US)

( * ) Notice: Subject to any disclaimer, the term of this patent is extended or adjusted under 35 U.S.C. 154(b) by 7 days.

(21) Appl. No.: 10/877,808

(22) Filed: Jun. 25, 2004

(65) Prior Publication Data

US 2005/0050907 A1 Mar. 10, 2005

Related U.S. Application Data

(60) Provisional application No. 60/483,087, filed on Jun. 27, 2003.

(51) Int. Cl.
*F25D 17/04* (2006.01)

(52) U.S. Cl. ..... 62/187; 62/408

(58) Field of Classification Search ..... 62/186, 62/187, 209, 309, 324.6, 404, 407, 408, 441; 137/870; 251/257, 307
See application file for complete search history.

(56) References Cited

U.S. PATENT DOCUMENTS 3,590,594 A * 7/1971 Arend ..... 62/117
3,630,046 A 12/1971 Boor
3,893,307 A * 7/1975 Jacobs ..... 62/150
4,646,528 A * 3/1987 Marcade et al. ..... 62/127
4,759,693 A * 7/1988 Outzen ..... 417/312
4,879,878 A 11/1989 Polkinghorne
5,092,137 A 3/1992 Elsom
5,167,252 A * 12/1992 Rogne ..... 137/375
5,201,888 A * 4/1993 Beach et al. ..... 62/187
5,460,010 A * 10/1995 Kobayashi et al. ..... 62/187

(Continued)

FOREIGN PATENT DOCUMENTS

JP 4-198683 A * 7/1992

(Continued)

*Primary Examiner*—Mohammad M. Ali
(74) *Attorney, Agent, or Firm*—Alston & Bird LLP

(57) ABSTRACT

The invention consists of a unit 10 including a two-piece, snap together housing made of elements 40 and 50 which forms the orifice seat and the transitions which direct moisture away from the seat area and prevents the accumulation of moisture in the seat area. Left-Hand (LH) housing 50 contains a blind journal and right-hand (RH) housing portion 40 contains a through journal for support and location of the gate 60. Also integral to the RH housing portion 40 are bosses for attaching the snap action switches 80, which determine gate orientation and mounting a gear motor 90, and can generally be referenced as "gate position sensors". Such switches could also be replaced with other gate position sensors such as know in the art such as hall effect switches, magnetic switches, optical devices, etc.

The gear motor provides the driving torque to the gate 60 through a cam-coupling 70, which has four switch detents 71, oriented to an internal shaft indexing means. Insulation members 20, 30 minimize condensation in the housing portions 40, 50 by separating the cold air flowing through housing from the warmer air which surrounds the damper assembly 10. In operation, a temperature sensing device/system senses the compartment temperature and energizes the gear motor 90, rotating the gate 60 into the open or closed position. The position of the gate 60 is determined by the combination of the states of the two switches 80. When used with mechanical controls the gate will rotate 90 degrees per cycle. When used with an electronic control system, the gate 60 can be rotated to any desired position and then stopped.

17 Claims, 7 Drawing Sheets

U.S. PATENT DOCUMENTS 5,626,085 A * 5/1997 Donais et al. ..... 110/188
5,791,154 A * 8/1998 Schulak ..... 62/186
5,979,872 A * 11/1999 Stearns et al. ..... 251/305
6,058,726 A 5/2000 Noritake
6,266,966 B1 * 7/2001 Fernandez et al. ..... 62/186
6,647,960 B1 * 11/2003 Rauch et al. ..... 123/399
6,945,866 B1 * 9/2005 Demster ..... 454/248

FOREIGN PATENT DOCUMENTS

JP 2003-28551 A * 1/2003

* cited by examiner (Section 7B - 7B)

(Section 7D - 7D)

(Section 7F - 7F)

COLD CONTROL DAMPER ASSEMBLY

CROSS-REFERENCE TO RELATED APPLICATIONS

The present application claims the benefit and priority of U.S. provisional application 60/483,087 filed Jun. 27, 2003, and incorporates by reference the contents of that provisional application.

BACKGROUND OF THE INVENTION

1. Field of the Invention

This invention relates to the control of airflow between the freezer compartment and the refrigerator compartment (a.k.a. fresh food compartment) of a conventional consumer refrigerator/freezer by use of a valve (a.k.a. "damper") positioned within a passageway connecting the two compartments.

2. Description of Related Art

Current damper valve designs use sliding or hinged valve members to control the airflow between the refrigerator and freezer compartments of a conventional consumer refrigerator/freezer. The flow of cold air out of the freezer into the refrigerator is controlled by such valves, which therefore controls the temperature of the refrigerator. Ice buildup due to freezing condensation can prevent proper damper valve functioning, and leads to disadvantageous results in frozen or spoiled food in the fresh food compartment.

One type of current damper valve uses a gate, which is essentially a flat plate which slides between and is captured by two co-facing channels.

Another prior art damper valve version includes the use of a device that has a pivot in a corner. A rod provides a pivot point.

These prior art devices can tend to 'freeze up' due to condensation. This is disadvantageous.

Therefore, it may be seen that there is a need in the art for an improved damper value system in a refrigerator/freezer environment.

BRIEF SUMMARY OF THE INVENTION

The present invention provides a means of controlling airflow between the freezer compartment and the fresh food compartment of a refrigerator by means of a rotating gate in a circular orifice. In one embodiment this is a butterfly valve, which can be rotated by use of a motor providing torque about its pivot axis, or a linear actuator which provides a linear force having a force element tangential to the rotation of the butterfly valve.

Generally described, the present invention relates to a combination refrigerator/freezer unit, the unit comprising:

A) a refrigerator portion;

B) a freezer portion;

C) a valve in between the two portions, the valve itself comprising:

a housing portion defining an air passageway; and a butterfly valve including a gate portion pivotable about an axis transversing the air passageway, the gate portion capable of substantially closing the air passageway, but the gate portion also being capable of knocking off ice formed on at least part of the passageway.

The present invention is also directed at a combination refrigerator/freezer unit, the unit comprising:

A) a refrigerator portion

B) a freezer portion

C) a valve in between the two portions, the valve itself comprising:

a housing portion defining an air passageway a butterfly valve including a gate portion pivotable about an axis transversing the air passageway, the gate portion capable of substantially closing the air passageway, but the gate portion also being capable of knocking off ice formed on at least part of the passageway;

an insulating portion for insulating at least a portion of the housing portion;

gate portion sensors configured to provide feedback on the position of the gate portion; and electronics for determining the location of the gate, with such electronics facilitating the manipulation of the valve to something other than fully open or fully closed.

The present invention is also directed towards an apparatus for controlling air flow between the refrigerator portion and the freezer portion of a combination refrigerator/freezer unit, the apparatus comprising:

a valve in between the two portions, the valve itself comprising:

a housing portion defining an air passageway; and a butterfly valve including a gate portion pivotable about an axis transversing the air passageway, the gate portion capable of substantially closing the air passageway, but the gate portion also being capable of knocking off ice formed on at least part of the passageway.

The present invention is also directed towards a combination refrigerator/freezer unit, the unit comprising:

A) a refrigerator portion

B) a freezer portion

C) a valve in between the two portions, the valve itself comprising:

a housing portion defining an air passageway a butterfly valve including a gate portion pivotable about an axis transversing the air passageway, the gate portion capable of substantially closing the air passageway, but the gate portion also being capable of knocking off ice formed on at least part of the passageway;

an insulating portion for insulating at least a portion of the housing portion;

gate portion sensors configured to provide feedback on the position of the gate portion; and electronics for determining the location of the gate, with such electronics facilitating the manipulation of the valve to something other than fully open or fully closed.

The present invention is also directed towards a method of providing air communication between the refrigerator portion and the a freezer portion of a combination refrigerator/freezer unit, the method including the use of electronics for determining the location of the gate, with such electronics facilitating the manipulation of the valve to something other than fully open or fully closed.

Finally, the present invention is directed towards a method of providing air communication between the refrigerator portion and the a freezer portion of a combination refrigerator/freezer unit, the method including the use of a linear actuator to drive a rotating valve, with the free end of a lever would be driven by the actuator.

Therefore, it is an object of the present invention to provide an improved consumer refrigerator/freezer design.

It is a further object to provide an improved consumer refrigerator/freezer, which includes a self-defrosting freezer section.

It is a further object to provide an improved valve intermediate the freezer and refrigerator section of a consumer refrigerator/freezer.

It is a further object to provide a refrigerator/freezer having a an improved valve intermediate said freezer and refrigerator section, said valve being resistant to the building of ice on the valve and the resulting seizure of the valve.

It is a further object to provide a refrigerator/freezer having an improved valve intermediate said freezer and refrigerator section, which is simple to operate.

It is a further object to provide a refrigerator/freezer having an improved valve intermediate said freezer and refrigerator section, which is simple to manufacture.

It is a further object to provide a refrigerator/freezer having an improved valve intermediate said freezer and refrigerator section, which is effective in operation.

It is a further object to provide a refrigerator/freezer having an improved valve intermediate said freezer and refrigerator section, which is reliable.

Other objects, features, and advantages of the present invention will become apparent upon reading the following detailed description of the preferred embodiment of the invention when taken in conjunction with the drawings and the appended claims.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 is a pictorial view of the assembled cold control damper assembly 10, which shows the gate 60 in a substantially closed position therein. Also shown is the wiring assembly 120 and the motor 90.

FIG. 2 is a view of the back of the apparatus 24 showing not only the motor 90 and the wiring 120, but also the grate 110. When the gate 60 is open, air flows through the grate 110.

FIG. 3 is view of a subassembly of the assembly 10, namely elements 40, 50, 60, and 70, with the gate 60 shown in a closed position. Note the curved arrow and axis line, which illustrates the rotational axis of the gate 60.

FIGS. 4A, 4B and 4C are various views. FIG. 4B will be considered the "front" elevational view", looking at the opening including the gate 60. FIG. 4A will thus be considered the right side elevational view, and FIG. 4C will be considered the top plan view. Within these views, dimension A is an assembled cold control damper assembly 10, from three points of view. Dimension A is approximately 4.2 inches, dimension B is approximately 3.3 inches, and dimension C is approximately 4.2 inches, although these dimensions are not critical to the invention and should not be seen as limiting.

FIG. 5 is an exploded view of many elements of the cold control damper assembly 10 according to present invention. It may be understood that the rotation axis "R" discussed in FIG. 3 would be horizontal as this FIG. 5 is viewed.

FIGS. 6A and 6B are illustrative views of the positioning of the element 10 within a refrigerator/freezer environment provided by a refrigerator unit. FIG. 6A illustrates the element 10 within a Refrigerator/freezer unit 200 in which the refrigerator enclosure portion 300 and the freezer enclosure portion 400 are "side by side", with the refrigerator enclosure portion 300 to the viewer's right of the freezer enclosure portion 400, although these relationships could be reversed. FIG. 6A illustrates the element 10 within a refrigerator/freezer unit 200' in which the refrigerator enclosure portion 300 and the freezer enclosure portion 400 are in an "over and under" relationship, with the refrigerator enclosure portion 300 below the freezer enclosure portion 400, although these relationships could be reversed.

FIG. 7A is a bottom plan view of the coupling 70, and shows the second (or "lower") end of the coupling 70; note the D-shaped hole to accept the gate.

FIG. 7B is the cross-section taken across lines 7B—7B in FIG. 7A. The first, or "top" end (when in use) of the coupling (having the D-shaped hole) is directed downwardly as shown in this cross section, and the second, or "bottom" end (having the gear-shaped hole) of the coupling is shown directed upwardly in this cross section.

FIG. 7C is an elevational view of the coupling with the first (upper) end directed right, and the second (lower) end directed left. The rotational axis of the coupling could be understood as being horizontal in this view.

Figure 7A:
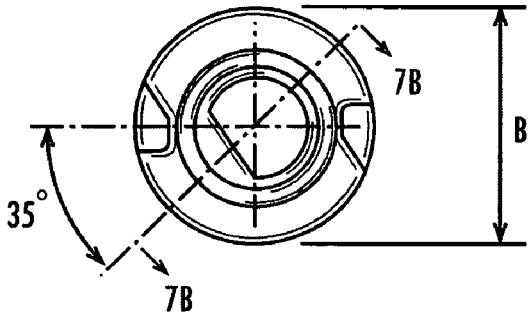
FIGS. 7A–FIG. 7F are various related views of cam-coupling element 70.
Figure 7B:
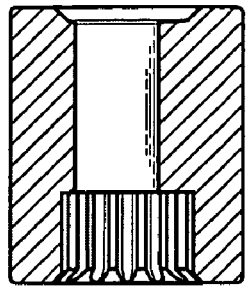
Figure 7C:
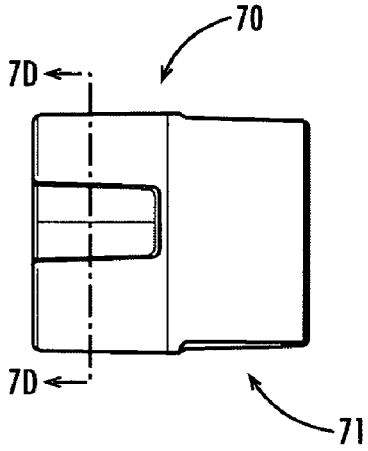
Figure 7D:
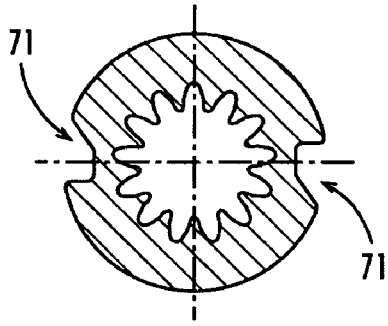

FIG. 7D is a section view along line 7D—7D of FIG. C. This shows the gear-shaped cavity which will face the motor.

Figure 7E:
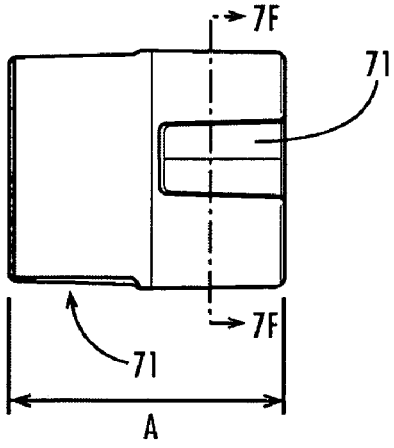

FIG. 7E is a view similar to FIG. 7C, except that the coupling could be thought of as being rotated 90 degrees along its longitudinal axis. However, the first end is still to the right and the second end is still to the left.

Figure 7F:
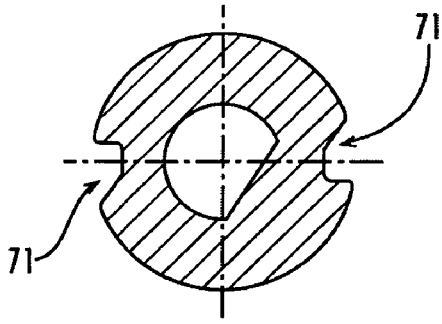

FIG. 7F is a section view along line 7F—7F, showing the D-shaped hole that will downwardly face the gate.

Figure 8:
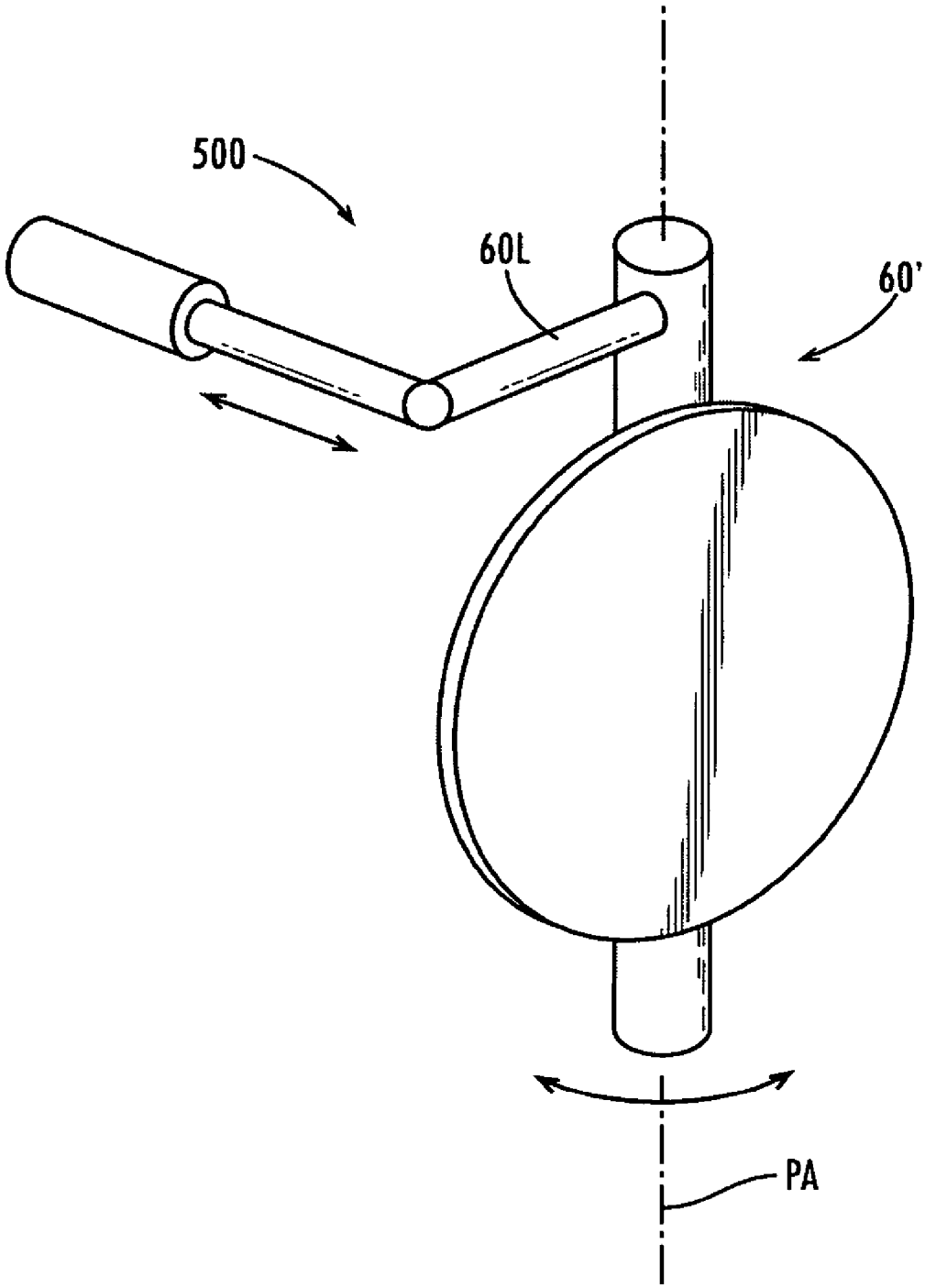

FIG. 8 is an illustrative view of another embodiment of the invention, in which a linear actuator 500 is used to open and shut the gate valve 60' having a lever portion 60L.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

General Construction and Operation

Figure 1:
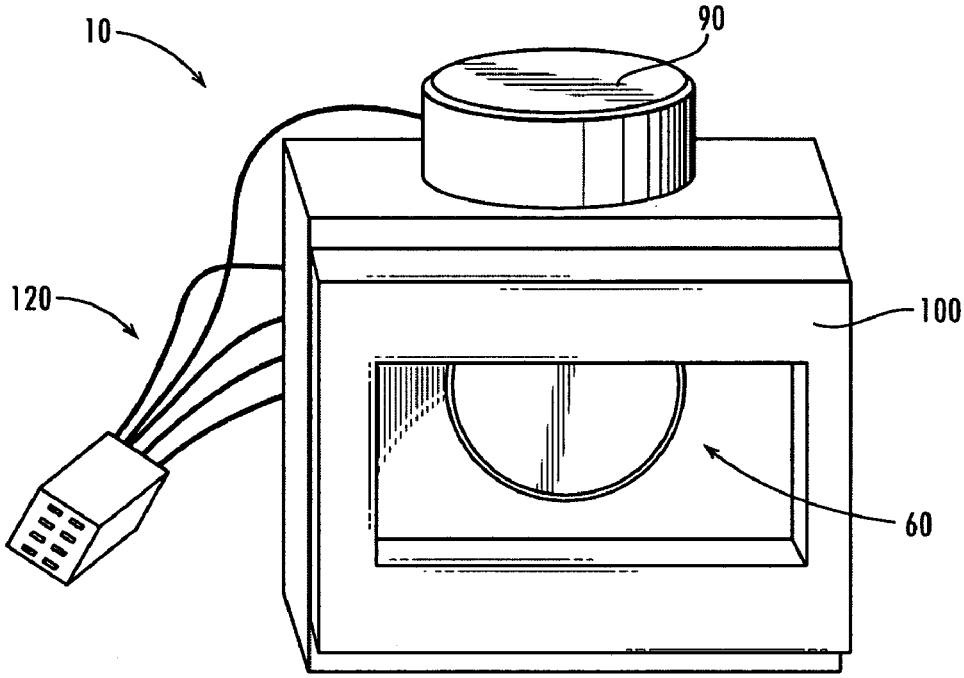
Figure 6A:
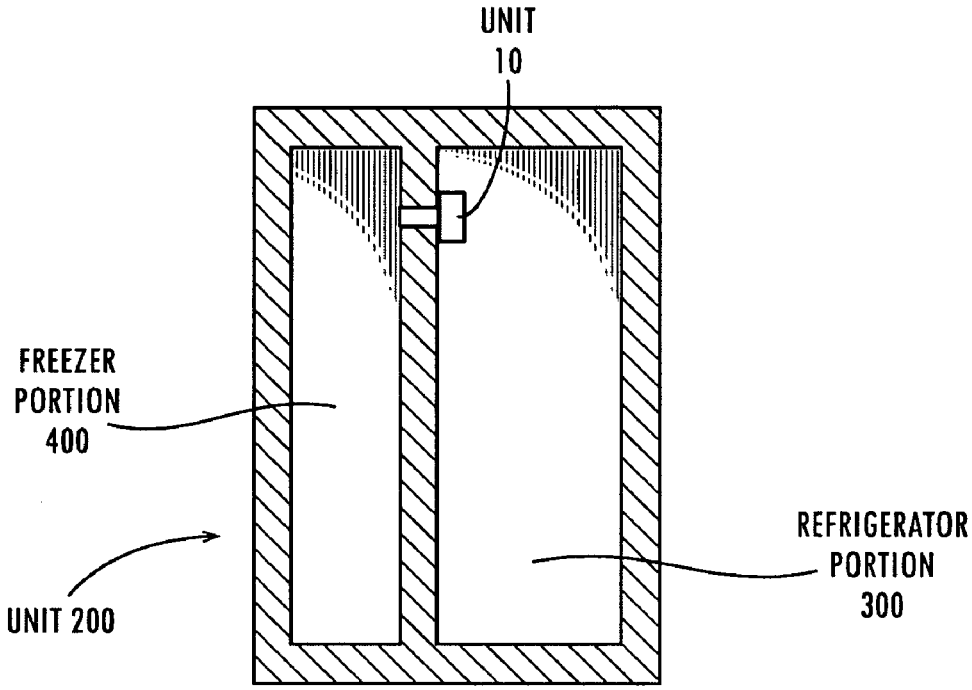
Figure 6B:
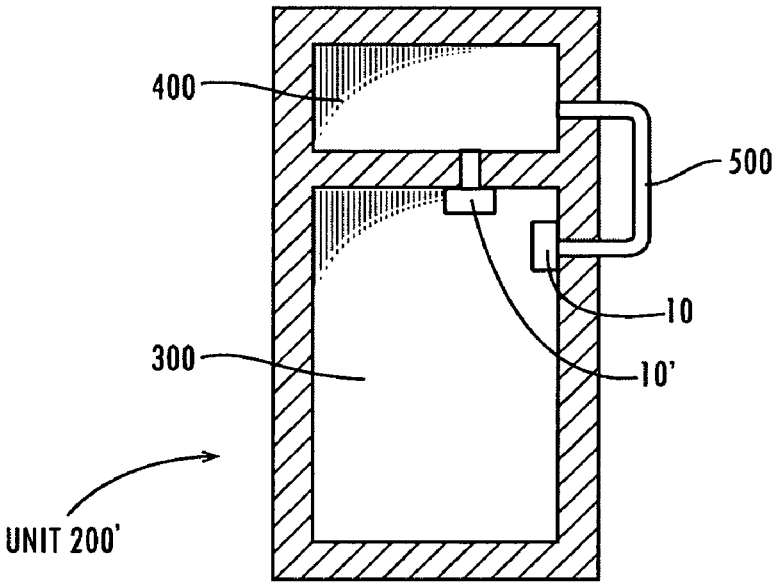

Generally described, referring generally to FIG. 1 and FIGS. 6A and 6B, the present invention relates to a means of controlling airflow between the freezer compartment 400 (a.k.a. "freezer portion 400") and the fresh food compartment 300 (a.k.a. "refrigerator portion 300") of a refrigerator unit 200 by means of a device 10 including a rotating gate 60 in a circular orifice defining "lands". In one embodiment the rotating gate is a butterfly valve, which can be rotated by use of a motor providing torque about its pivot axis, or a linear actuator (see FIG. 8), which provides a linear force having a force element tangential to the rotation of the butterfly valve.

In one embodiment, the invention consists of a two-piece, snap together housing made of elements 40 and 50 which forms the orifice seat and the transitions which direct moisture away from the seat area and prevents the accumulation of moisture in the seat area. Referring now also to the all of the figures, Left-Hand (LH) housing portion 50 contains a blind journal and right-hand (RH) housing portion 40 contains a through journal for support and location of the gate 60. Also integral to the RH housing portion 40 are bosses for attaching the snap action switches 80, which determine gate orientation and mounting a gear motor 90.

The gear motor 90 provides the driving torque to the gate 60 through a cam/coupling 70, which has four switch detents, oriented to an internal shaft indexing means. Insulation members 20, 30 minimize condensation in the housing portions 40, 50 by separating the cold air flowing through housing from the warmer air which surrounds the damper assembly.

In operation, a temperature sensing device/system senses the compartment temperature and energizes the gear motor, rotating the gate 60 into tbe open or closed position. The position of the gate is determined by the combination of the states of the two switches 80,or "gate position sensors". When use with mechanical controls the gate will rotate 90 degrees per cycle. When used with an electronic control system, the gate can be rotated through any number of 90-degree steps and then stopped.

As shown in FIG. 6A, the unit 10 is typically provided on the "refrigerator side" of the vertical wall of a refrigerator/freezer unit having a "side-by-side" configuration such as unit 200 shown in FIG. 6A. The unit is configured to be attached to (or alternately in—not shown) the wall by means known in the art An air passageway is provided in the vertical wall to allow air to communicate between the two portions 300, 400.

In the configuration shown in FIG. 6B, the unit 10 is typically provided somewhere in the refrigerator portion 300, and an air passageway is provided in some manner to facilitate air communication between the two portions 300, 400. One location of the unit is as shown for unit 10 in FIG. 6B, that being on a vertical wall of the refrigerator portion 300, with a conduit such as 500 providing air communication between the two portions 300, 400. The vertical wall could be a side wall or a back wall. It should also be understood that a conduit could be used to connect a unit located on the lower, "floor" wall of the refrigerator portion 300, although this would require additional conduit length.

FIG. 6B also shows an alternate location designated as 10' in which the unit 10' is positioned on the horizontal wall which separates the two portions 300, 400. In this configuration an air passageway is provided in such a horizontal wall, providing air communication between the two portions 300, 400.

The gear motor 90 provides the driving torque to the gate 60, such that the gate can open and close. As noted above, linear actuation as shown in FIG. 8 is also contemplated under the present invention.

More Detailed Discussion

The damper assembly 10 according to one portion of the present invention includes the following components:

Right Hand (RH) Insulation Member 20
Left Hand (LH) Insulation Member 30
Right Hand (RH) Housing Portion 40
Left Hand (LH) Housing Portion 50
Gate 60
Cam-Coupling Element 70
Switches (or Gate position Sensor) (2) 80
Motor 90
Foam Seal 100
Louvered Grate 110
Wiring Assembly 120
RH and LH Insulation Members 20, 30

As shown in, for example, FIG. 5, the RH and LH insulation members 20, 30, respectively, when coupled together by tape or adhesive or the like, capture the subassembly, discussed in more detail below, which includes the elements 40, 50 and 60. These insulation members provide insulation and also provide mounting locations for an air louver 110 (a/k/a a grate 110), or similar device.

Figure 4A:
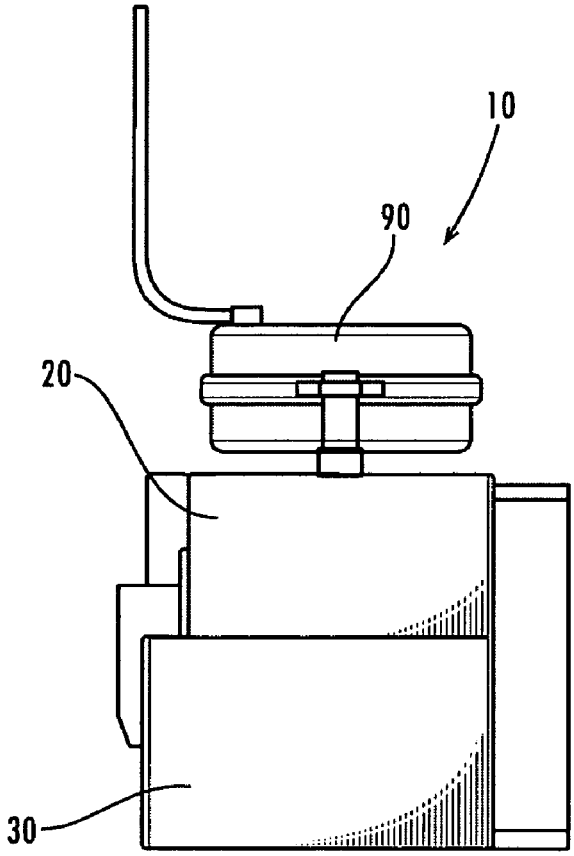

The Right-Hand Insulation Member 20 includes a hole to allow the cam-coupling element 70 to accept the longer stub shaft 62 (see FIG. 4) of the gate 60, discussed in detail elsewhere. The Right-Hand Insulation Member 20 also includes a slot to facilitate mounting of the switches 80 to the Right Hand Housing Portion) and connection of electrical contacts to the switches.

Housing Portions 40, 50

Figure 5:
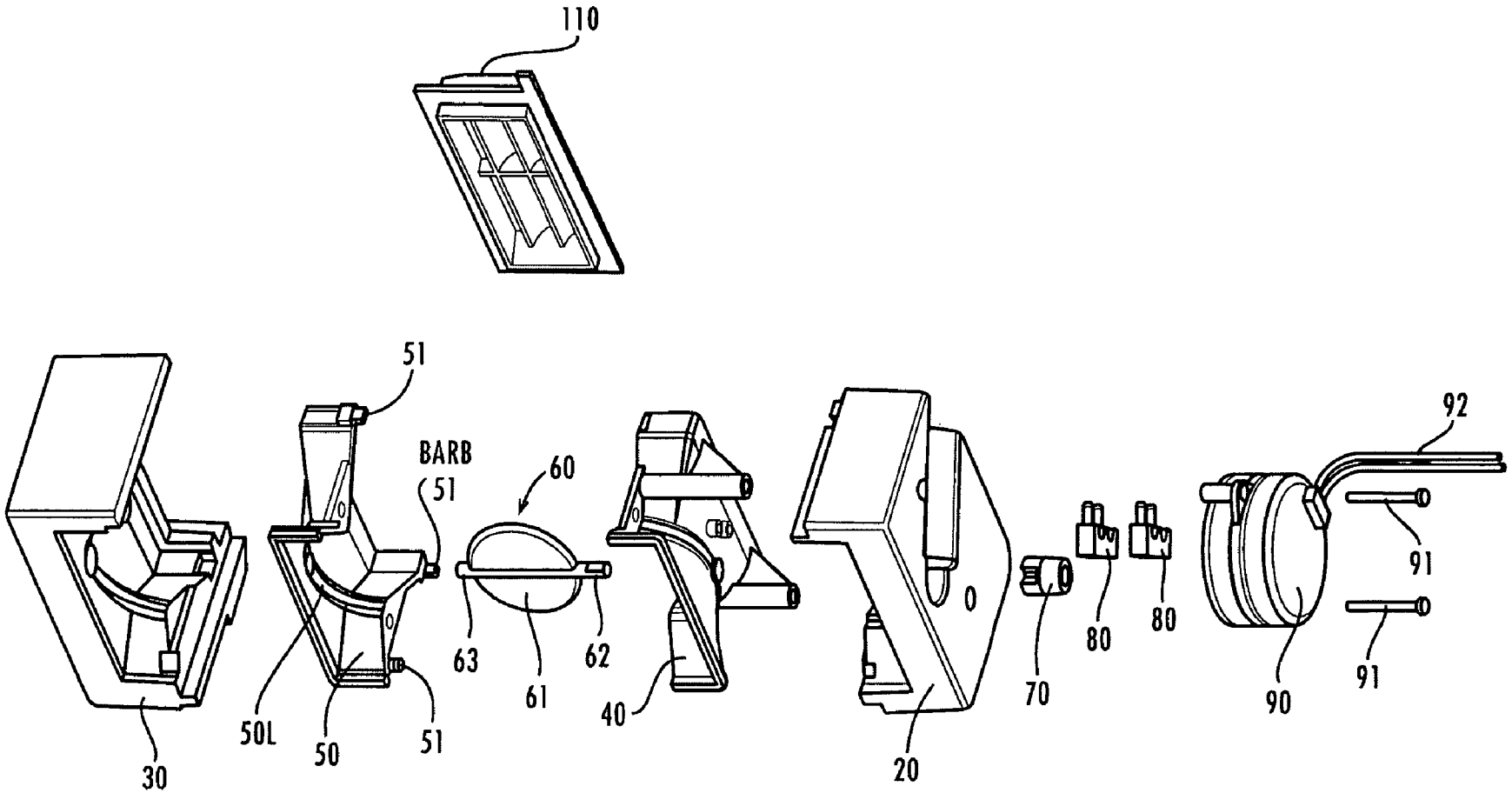

Continuing to refer to FIG. 5, when the two elements 40, 50, are put together, it may be seen that a substantially circular passageway hole is defined. This hole is configured to be selectively closed by use of the gate 60, by selective rotation of the gate 60.

The Right Hand Housing Portion 40 and the Left Hand Housing Portion 50 fit together in a clamshell fashion and are secured together by use of snapping barbs such as 51 of Housing Portion 50. When the elements 40 and 50 "snap" together, they define a passageway which is shaped to be closed by the gate 60. They also capture the pivoting gate 60, which includes two opposing stub shaft elements 61, 62 which fit within holes defined by housing portions 50, 40, respectively. The portion 50 includes a "blind" hole, which accepts the shorter stub shaft 61 of the gate 60 whereas the portion 40 defines a through hole which accepts the longer stub shaft 62 of the gate 60. As discussed in detail elsewhere, stub shaft 62 includes a flat spot to facilitate engagement with a D-shaped hole defined by one end of the cam-coupling element 70, to allow for radial engagement of the two along a drive train.

Gate 60

Figure 3:
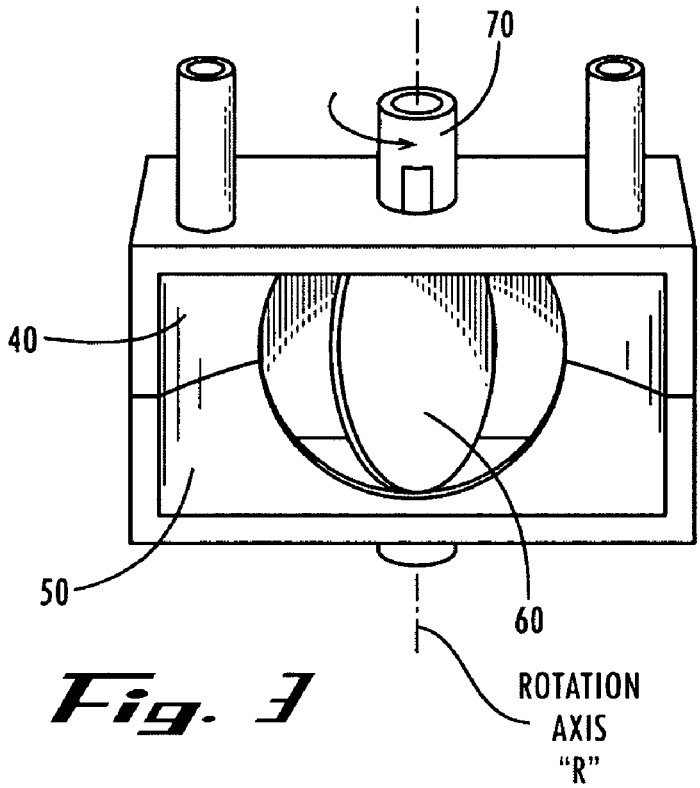

The pivoting gate 60 is moved about its longitudinal axis about rotating axis "R" (See FIG. 3) by use of motor 90. Referring now also to FIG. 5, the pivoting gate 60 includes a main planar member 61, a longer stub shaft 62, and a shorter stub shaft 63. The longer stub shaft has a flat spot (seen in FIG. 5) which allows for engagement with a D-shaped hole defined by the cam-coupling element 70.

It should be understood that the gate 60, if free to rotate about its axis, could, although it is not necessary, rotate 360 degrees without interference from the members 40, 50 (assuming the drive motor and any other controls were removed or deactivated). Such rotation could be used to include an "overtravel" feature in which the relevant edges of the gate would pass the lands (for ice clearance) and then retract back to their most closed position (edges closely adjacent the lands).

Coupling 70

A cam-coupling 70 provides an interconnection between the longer stub shaft 62 on the gate 60 and the motor, to allow torque to be transmitted from the motor 90 to the gate 60. The longer stub shaft 62 includes a flat spot, which allows for a connection between the first end of the coupling, which includes a D-shaped hole and thus precludes radial slippage. This first end is shown well in FIG. 7A. The second end of the coupling is selectively engagable with a drive gear which is driven by the motor 90.

Referring particularly to FIG. 7D, the coupling may be seen to have one end (shown in the Section B–B view), which presents a hole that is gear-shaped, and one end (see FIGS. 7A and 7F), which is D-shaped. Note also the opposing detents 71, which cooperate with the switches to allow the switches to provide signals as needed to indicate the rotational position of the cam-coupling element 70, and thus the gate 60.

Switches (or Gate position Sensor) 80

In one embodiment, the two switches 80 cooperate with the cam-coupling 70 as noted above. However, one or even no switches can be used, depending on the type of feedback desired. Optics, reed switches, or stepper motors could be used in the alternative.

Motor 90

The motor 90 is shown in FIGS. 1, 2, 4, and 5. The motor in one configuration includes a pinion gear which serves as an output means, although other configurations are contemplated under the spirit and scope of the present invention. The motor 90 is mounted by fasteners 91 (see FIG. 1) to the Right-Hand Housing Portion 40. The fasteners pass through holes in the Right Hand Insulation Member 20.

Figure 2:
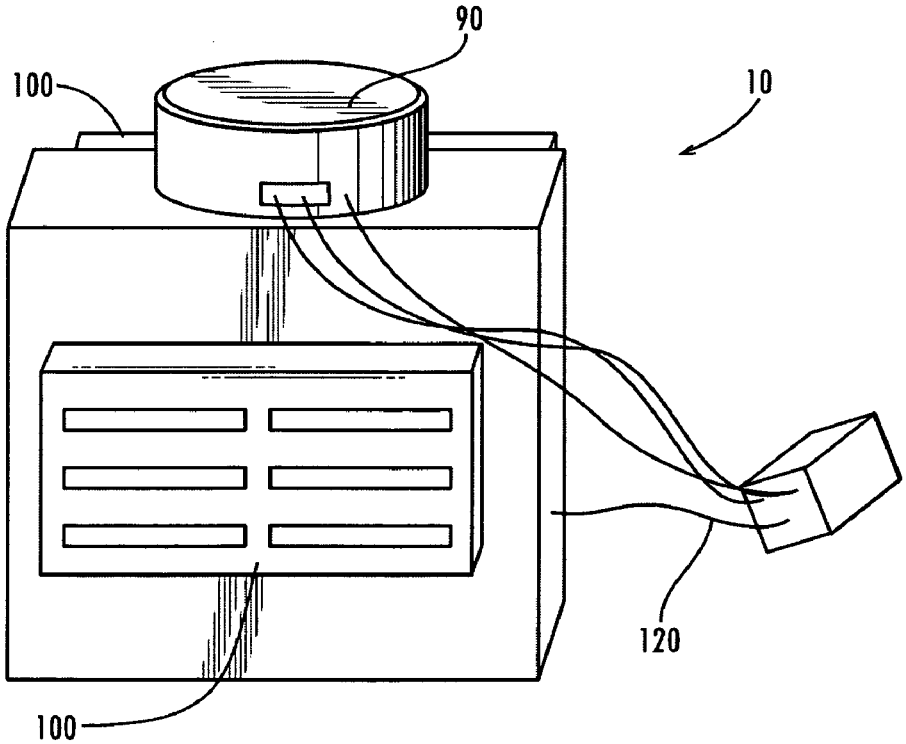
Figure 4B:
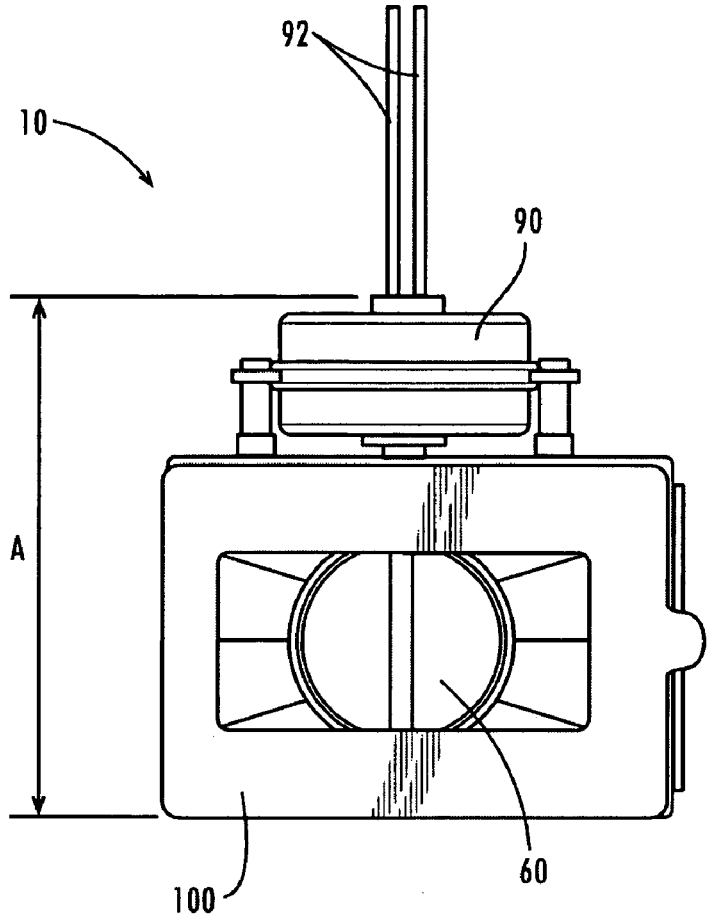

The electrical leads 92 shown in FIG. 4B are part of the overall wiring assembly 120 of, for example, FIGS. 1 and 2.

In one embodiment, the motor is an AC motor, although a DC or even a stepper motor may also be used, especially if more particular control is needed. It should also be understood that the motive power for the turning of the butterfly could be done by other means. Possibly the damper could be operated by a thermal spring, hydraulic actuator, or other means.

Foam Seal 100

The damper assembly 10 is in the refrigerator side of the refrigerator. The foam gasket seal 100 goes against the cabinet wall and against the insulation members 20, 30.

Louvered Grate 110

The louvered grate 110, if used, is mounted on the refrigerator side of the assembly 10, and is held in place by adhesives or other suitable attachment means.

Wiring Assembly 120

The wiring assembly 120 is used to connect the motor 90 and the switches 80.

As may be understood, different sizes of wires may be used. The smaller wires are typically five-volt control wires that go back to the control system. Two particular wires can be longer than the others, and accept 120 volts. These two larger wires (shown as 92 in FIG. 4A) in one embodiment go to the motor 90.

Other Embodiments/Options

Under one embodiment of the present invention, pivoting is done about the center; said another way, gate portion pivots about an axis that transverses the air passageway at approximately the center of the passageway.

The pivoting range is approximately 90 degrees. However, other embodiments are contemplated under the present invention. Mechanically, the first embodiment will stop just because the cam configuration is a certain way. The first embodiment stops in 90-degree increments just because of the way the cam is made.

However, under another embodiment of the present invention, with the use of appropriate electronics, rotation can be multiple times, or could be 270 degrees, or some other range. However, the typical configuration will be from 0 degrees (closed) to 90 degrees (opened).

Under another configuration, control could be dependent upon other aspects of operation of the overall device; the opening could be partial (45 degrees) or at other angles, depending upon the needs of the system.

Other options include the use of a DC motor as opposed to an AC motor.

Reference is also now made to FIG. 8, which is an illustrative view of another embodiment of the invention, in which a linear actuator 500 (which can be electrically, hydraulically, air or otherwise driven) is used to open and shut the gate valve 60' having a lever portion 60L. The lever portion extends generally radially from the pivoting axis PA of the gate valve 60'. As may be understood, the gate valve 60' pivots about an axis PA as described before, but in this configuration the linear actuator 500 is positioned such that its longitudinal axis is perpendicular and spaced from said pivoting axis PA, such that the linear axis pushes the lever portion 60L and causes the rotation. As may be understood, the more the linear actuator 500 is extended, the more the gate valve 60' pivots.

Advantages

The device according to the present invention is essentially "self-cleaning". If the ice does have a chance to build up, it then clears itself out. This is provided by the use of a relatively thin land area which is defined by the combination of the Right Hand Housing Portion 40 and the Left Hand Housing Portion 50. The land area 50L defined by the Left Hand Housing Portion 50 is shown in FIG. 5, but the similarly shaped land area defined by the Right Hand Housing Portion 40 is almost completely hidden in the view.

On either side of this land area, the surface of the housing portions 40, 50, tend to taper off at an angle. If any ice accumulates on this these relatively thin land areas, the ice tends to be readily knocked off by the moving edges of the gate valve.

Materials and Dimensions

The cam-coupling element 70 is made of ABS although other materials are contemplated without departing from the spirit and scope of the present invention. In fact, many different materials could be used as known in the art for the various elements of the invention.

Figure 4C:
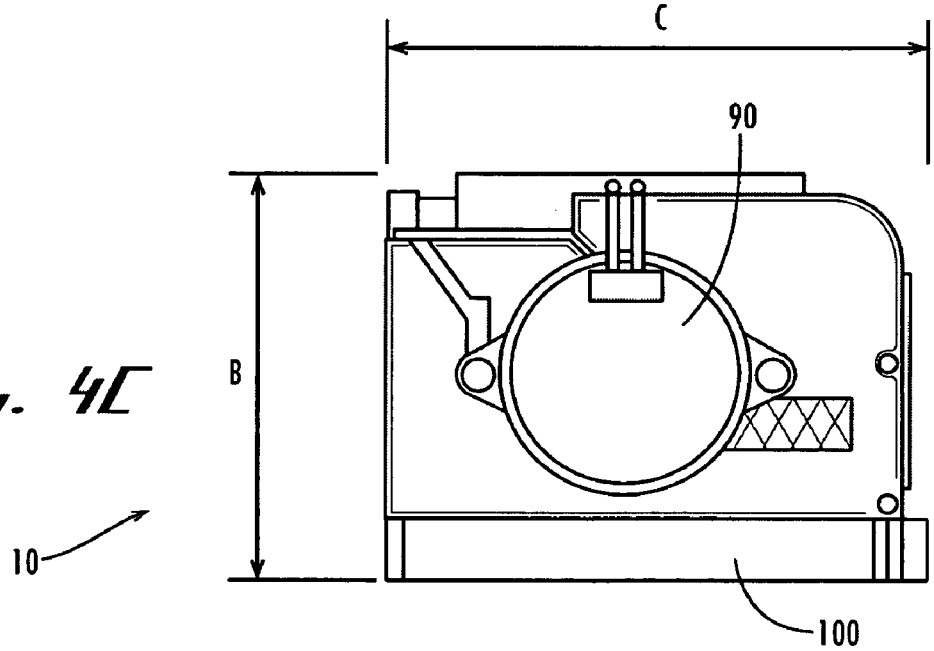

In the assembled cold control damper assembly 10 shown in FIG. 4, dimension A is approximately 4.2 inches, dimension B is approximately 3.3 inches, and dimension C is approximately 4.2 inches, although these dimensions are not critical to the invention and should not be seen as limiting.

In the cam-coupling element 70 shown in FIG. 7, dimension A is approximately 0.575 inches and dimension B is approximately 0.5 inches, although these dimensions are not critical to the invention and should not be seen as limiting.

Element Lists

The damper assembly 10 according to one embodiment of the present invention includes the following components:

- Right Hand (RH) Insulation Member 20
- Left Hand (LH) Insulation Member 30
- Right Hand (RH) Housing Portion 40
- Left Hand (LH) Housing Portion 50
- Engagement Barbs 51
- Gate 60
  - Main Planar Member 61
  - Longer Stub Shaft 62
  - Shorter Stub Shaft 63
- Cam-Coupling Element 70
  - Detents 71 (see FIG. 10)
- Switches (or Gate position Sensor) (2) 80
- Motor 90
  - Motor Mounting Fasteners 91
  - Motor Electrical Leads 92

Foam Seal 100
Louvered Grate 110
Wiring Assembly 120

The overall invention also includes the device used in conjunction with the following components:

Refrigerator/freezer unit 200
Refrigerator enclosure portion 300
Freezer enclosure portion 400
Conduit 500

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A combination refrigerator/freezer unit, said unit comprising:
A) a refrigerator portion;
B) a freezer portion; and
C) a valve in between the two portions, said valve itself comprising:
a housing portion defining a substantially circular air passageway hole and further defining a land area, said land area defining a surface portion along the circumference of said hole;
a butterfly valve including a gate portion pivotable about an axis transversing said substantially circular air passageway hole, said gate portion capable of substantially closing said air passageway hole, but said gate portion also being capable of knocking off ice formed on said land area.

2. The combination refrigerator/freezer unit as claimed in claim 1, wherein said gate portion is mounted within said housing portion such that it could rotate a full 360 degrees if it was free from any drive or control means.

3. A combination refrigerator/freezer unit, said unit comprising:
A) a refrigerator portion;
B) a freezer portion; and
C) a valve in between the two portions, said valve itself comprising:
a housing portion defining a substantially circular air passageway hole and further defining a land area, said land area defining a surface portion along the circumference of said hole;
a butterfly valve including a gate portion pivotable about an axis transversing said substantially circular air passageway hole, said gate portion capable of substantially closing said air passageway hole, but said gate portion also being capable of knocking off ice foamed on said land area; and
an insulating portion for insulating at least a portion of said housing portion.

4. The combination refrigerator/freezer unit as claimed in claim 3, wherein said gate portion is mounted within said housing portion such that it could rotate a full 360 degrees if it was free from any drive or control means.

5. A combination refrigerator/freezer unit, said unit comprising:
A) a refrigerator portion;
B) a freezer portion; and
C) a valve in between the two portions, said valve itself comprising:
a housing portion defining a substantially circular air passageway hole and further defining a land area, said land area defining a surface portion along the circumference of said hole;
a butterfly valve including a gate portion pivotable about an axis transversing said substantially circular air passageway hole, said gate portion capable of substantially closing said air passageway hole, but said gate portion also being capable of knocking off ice formed on said land area;
an insulating portion for insulating at least a portion of said housing portion; and
gate position sensors configured to provide feedback on the position of said gate portion.

6. The combination refrigerator/freezer unit as claimed in claim 5, wherein said gate portion pivots about an axis that transversing said air passageway at approximately the center of the passageway.

7. The combination refrigerator/freezer unit as claimed in claim 5, wherein said gate position sensor is a mechanical electrical switch.

8. The combination refrigerator/freezer unit as claimed in claim 5, wherein said gate portion is mounted within said housing portion such that it could rotate a full 360 degrees if it was free from any drive or control means.

9. A combination refrigerator/freezer unit, said unit comprising:
A) a refrigerator portion;
B) a freezer portion;
C) a valve in between the two portions, said valve itself comprising:
a housing portion defining a substantially circular air passageway hole and further defining a land area, said land area defining a surface portion along the circumference of said hole;
a butterfly valve including a gate portion pivotable about an axis transversing said substantially circular air passageway hole, said gate portion capable of substantially closing said air passageway hole, but said gate portion also being capable of knocking off ice formed on said land area;
an insulating portion for insulating at least a portion of said housing portion;
gate position sensors configured to provide feedback on the position of said gate portion; and
electronics for determining the location of the gate, with such electronics facilitating the manipulation of the valve to something other than fully open or fully closed.

10. An apparatus for controlling air flow between the refrigerator portion and the freezer portion of a combination refrigerator/freezer unit, said apparatus comprising:
a valve in between the two portions, said valve itself comprising:
a housing portion defining a substantially circular air passageway hole and further defining a land area, said land area defining surface portion along the circumference of said hole; and
a butterfly valve including a gate portion pivotable about an axis transversing said substantially circular air passageway hole, said gate portion capable of substantially closing said air passageway hole, but said gate portion also being capable of knocking off ice formed on said land area.

11. The apparatus as claimed in claim 10, wherein said gate portion is mounted within said housing portion such that it could rotate a full 360 degrees if it was free from any drive or control means.

12. An apparatus for controlling air flow between the refrigerator portion and the freezer portion of a combination refrigerator/freezer unit, said apparatus comprising:

a valve in between the two portions, said valve itself comprising:

a housing portion defining substantially circular air passageway hole and further defining a land area, said land area defining a surface portion along the circumference of said hole;

a butterfly valve including a gate portion pivotable about an axis transversing said substantially circular air passageway hole, said gate portion capable of substantially closing said air passageway hole, but said gate portion also being capable of knocking off ice formed on said land area; and an insulating portion for insulating at least a portion of said housing portion.

13. The apparatus as claimed in claim 12, wherein said gate portion is mounted within said housing portion such that it could rotate a full 360 degrees if it was free from any drive or control means.

14. An apparatus for controlling air flow between the refrigerator portion and the freezer portion of a combination refrigerator/freezer unit, said apparatus comprising:

a valve in between the two portions, said valve itself comprising:

a housing portion defining a substantially circular air passageway hole and further defining a land area, said land area defining a surface portion along the circumference of said hole;

a butterfly valve including a gate portion pivotable about an axis transversing said substantially circular air passageway hole, said gate portion capable of substantially closing said air passageway hole, but said gate portion also being capable of knocking off ice formed on said land area;

an insulating portion for insulating at least a portion of said housing portion; and gate position sensors configured to provide feedback on the position of said gate portion.

15. The apparatus as claimed in claim 14, wherein said gate portion pivots about an axis that transversing said air passageway at approximately the center of the passageway.

16. The apparatus as claimed in claim 14, wherein said gate position sensor is a mechanical electrical switch.

17. An apparatus for controlling air flow between the refrigerator portion and the freezer portion of a combination refrigerator/freezer unit, said apparatus comprising:

a valve in between the two portions, said valve itself comprising:

a housing portion defining substantially circular air passageway hole and further defining a land area, said land area defining a surface portion along the circumference of said hole;

a butterfly valve including a gate portion pivotable about an axis transversing said substantially circular air passageway hole, said gate portion capable of substantially closing said air passageway hole, but said gate portion also being capable of knocking off ice formed on said land area;

an insulating portion for insulating at least a portion of said housing portion; and gate position sensors configured to provide feedback on the position of said gate portion; and electronics for determining the location of the gate, with such electronics facilitating the manipulation of the valve to something other than fully open or fully closed.

* * * * *

UNITED STATES PATENT AND TRADEMARK OFFICE

CERTIFICATE OF CORRECTION

PATENT NO. : 7,107,775 B2
APPLICATION NO. : 10/877808
DATED : September 19, 2006
INVENTOR(S) : Unger et al.

It is certified that error appears in the above-identified patent and that said Letters Patent is hereby corrected as shown below:

Column 5,
Line 19, "tbe" should read --the--;
Line 22, "use" should read --used--.

Column 9,
Line 61, "foamed" should read --formed--.

Column 10,
Line 63, after "area defining" insert --a--.

Column 11,
Line 13, after "portion defining" insert --a--.

Column 12,
Line 19, after "portion defining" insert --a--.

Signed and Sealed this

Sixth Day of March, 2007

JON W. DUDAS
*Director of the United States Patent and Trademark Office*